US011128078B1

(12) United States Patent
Weaver et al.

(10) Patent No.: US 11,128,078 B1
(45) Date of Patent: Sep. 21, 2021

(54) CURRENT CARRYING RETENTION CLIP

(71) Applicant: TE Connectivity Services GmbH, Schaffhausen (CH)

(72) Inventors: Brian Keith Weaver, Harrisburg, PA (US); Vincent Ruminski, Camp Hill, PA (US); Divya Shukla, Harrisburg, PA (US); Michael Christopher D'Imperio, Harrisburg, PA (US); Gary Altemose, Harrisburg, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/932,946

(22) Filed: Jul. 20, 2020

(51) Int. Cl.
*H01R 13/115* (2006.01)
*H01R 13/11* (2006.01)
*H01R 13/631* (2006.01)

(52) U.S. Cl.
CPC ..... *H01R 13/115* (2013.01); *H01R 13/113* (2013.01); *H01R 13/631* (2013.01)

(58) Field of Classification Search
CPC .. H01R 13/115; H01R 13/113; H01R 13/631; H01R 13/187–43/16; H01H 85/22; H01H 85/20; H01H 85/2015; H01H 85/203; H01H 85/204; H01H 85/2045
See application file for complete search history.

(56) References Cited

U.S. PATENT DOCUMENTS

| | | | | |
|---|---|---|---|---|
| 4,992,062 | A * | 2/1991 | Nakayama | H01H 85/2035 439/620.26 |
| 8,662,455 | B2 | 3/2014 | Hernandez et al. | |
| 9,844,647 | B2 | 12/2017 | Knutsson | |
| 10,763,609 | B2 * | 9/2020 | Zhang | H01R 4/58 |
| 2008/0254688 | A1 | 10/2008 | Bogursky | |

* cited by examiner

*Primary Examiner* — Vanessa Girardi

(57) ABSTRACT

A current carrying clip contact and electrical connector have a first stationary beam and a movable beam. The first stationary beam has first planar tab engagement section and a first lead-in surface which extends from the first planar tab engagement section. The has a second planar tab engagement section, an arcuate retention section extending from the second planar tab engagement section, and a second lead-in surface extending from the arcuate retention section. The arcuate retention section of the movable beam is movable across a plane of the first planar tab engagement section of the first stationary beam as a mating tab is inserted between the first stationary beam and the movable beam.

20 Claims, 4 Drawing Sheets

CURRENT CARRYING RETENTION CLIP

FIELD OF THE INVENTION

The present invention is directed a current carrying clip. In particular, the invention is directed to a current carrying retention clip that provides sufficient normal force to make and retain an electrical connection between the current carrying retention clip and tabs which are inserted therein.

BACKGROUND OF THE INVENTION

Mounting hardware can be utilized to secure cylindrical components in a desired position. Spring clips, for example, provide a relatively simple, low cost, and easy to use means of retaining a cylindrical component in a desired position. Advantageously, a spring clip can secure a cylindrical component without the usage of adhesives or additional hardware by exerting a circumferential clamping force on the exterior of the cylindrical component. However, the spring clip itself must typically be mounted to an internal structure. The spring clips can be adhesively bonded to internal structure of the guided munition; however, this presents essentially the same drawbacks as does bonding the cylindrical component directly to the internal structure. Fasteners are commonly utilized to mechanically secure spring clips in place; however, the usage of fasteners adds undesired cost, complexity, and part count to the connector. In addition, spring clips can be easily deformed, thereby preventing an electrical connection from being made and maintained between the spring clip and the component inserted therein.

It would, therefore, be beneficial to provide a current carrying retention clip that provides sufficient normal force to make and retain an electrical connection between the current carrying retention clip and tabs of a passive component which are inserted therein.

SUMMARY OF THE INVENTION

An embodiment is directed to a current carrying clip contact. A base of the contact has a first end and an oppositely facing second end. A first stationary beam which extends from the first end of the base has a first planar tab engagement section and a first lead-in surface which extends from the first planar tab engagement section. The first lead-in surface is angled relative to the first planar tab engagement section. A movable beam which extends from the second end of the base has a second planar tab engagement section, an arcuate retention section extending from the second planar tab engagement section, and a second lead-in surface extending from the arcuate retention section. The second lead-in surface is angled relative to the second planar tab engagement section. The arcuate retention section of the movable beam is movable across a plane of the first planar tab engagement section of the first stationary beam as a mating tab is inserted between the first stationary beam and the movable beam.

An embodiment is directed to an electrical connector for receiving a passive component, the passive component includes a component housing and component tabs. The electrical connector has a housing with a component receiving recess and contact receiving recesses positioned on either side of the component receiving recess. The component receiving recess has guide projections to properly position the component housing in the component receiving recess. Current carrying clip contacts are positioned in the contact receiving recesses. The current carrying clip contacts include bases, first stationary beams and movable beams. The bases have first ends and oppositely facing second ends. The first stationary beams have first planar tab engagement sections and first lead-in surfaces which extend from the first planar tab engagement sections. The first lead-in surfaces are angled relative to the first planar tab engagement sections. The movable beams have second planar tab engagement sections, arcuate retention sections which extend from the second planar tab engagement sections, and second lead-in surfaces which extend from the arcuate retention sections. The second lead-in surfaces are angled relative to the second planar tab engagement sections. The arcuate retention sections of the movable beams are movable across planes of the first planar tab engagement sections of the first stationary beams as the component tabs are inserted between the first stationary beams and the movable beams.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
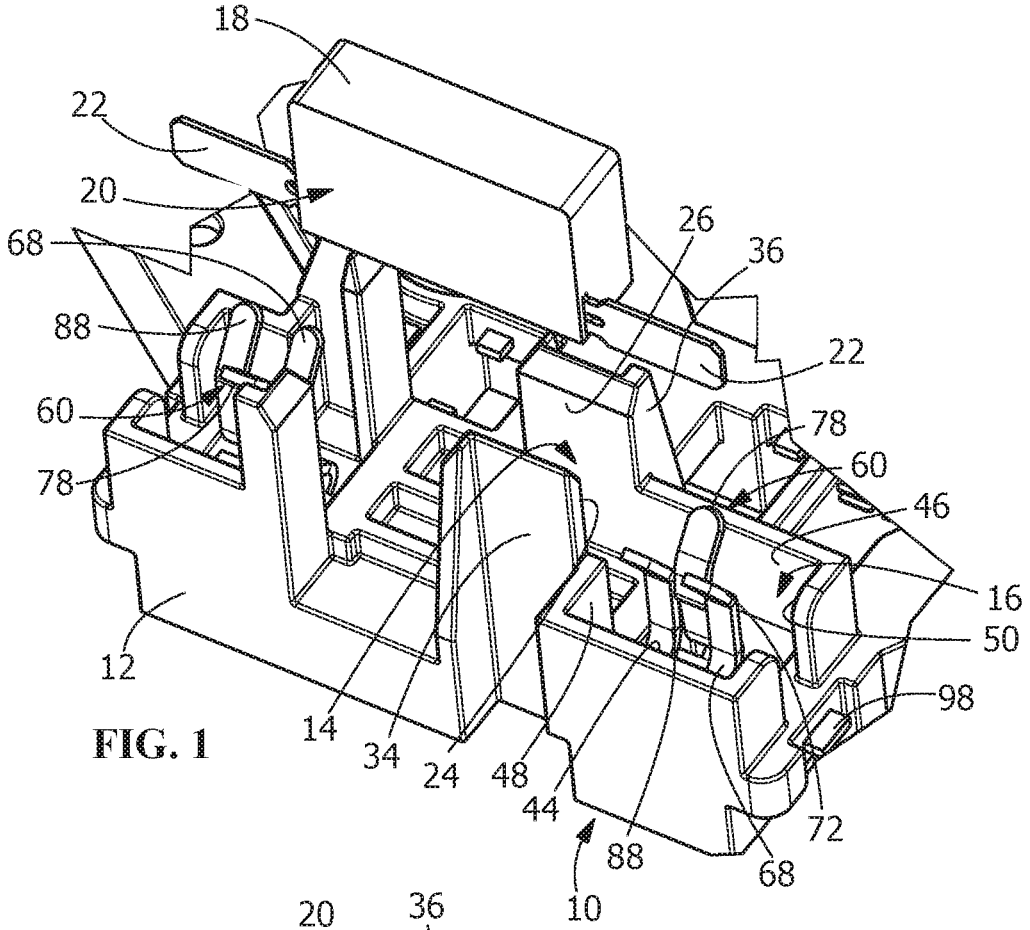
FIG. 1 is a top perspective view of an illustrative embodiment of an electrical connector with current carrying clip contacts according to the present invention, a passive component is exploded therefrom.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

As shown in FIG. 1, an electrical connector 10 has a housing 12 with a component receiving recess 14 and contact receiving recesses 16 positioned on either side of the component receiving recess 14. The component receiving recess 14 is dimensioned to receive a component housing 18 of a passive component 20. The contact receiving recesses 16 are configured to receive component electrical contacts or tabs 22 of the passive component 20.

The component receiving recess 14 has side walls 24, 26, end walls 28, 30 and a bottom wall 32. The side walls 24, 26 have guide projections 34, 36 which extend from the side walls 24, 26 in a direction away from the bottom wall 32. The guide projections 34, 36 cooperate with the component housing 18 to guide the component housing 18 into the component receiving recess 14 and properly position the component housing 18 in the component receiving recess 14. The end walls 28, 30 have openings or slots 42 to allow the component electrical contacts or tabs 22 to extend from the component receiving recess 14 into the contact receiving recesses 16.

In the embodiment shown, the side walls 24, 26, end walls 28, 30, bottom wall 32 and guide projections 34, 36 are formed by overmolding. However, other configurations of the side walls 24, 26, end walls 28, 30, bottom wall 32 and guide projections 34, 36 may be used.

Contact receiving recesses 16 are positioned on either side of the component receiving recess 14. The contact receiving recesses 16 have side walls 44, 46, end walls 48, 50 and bottom walls 52 (FIG. 2).

Figure 2:
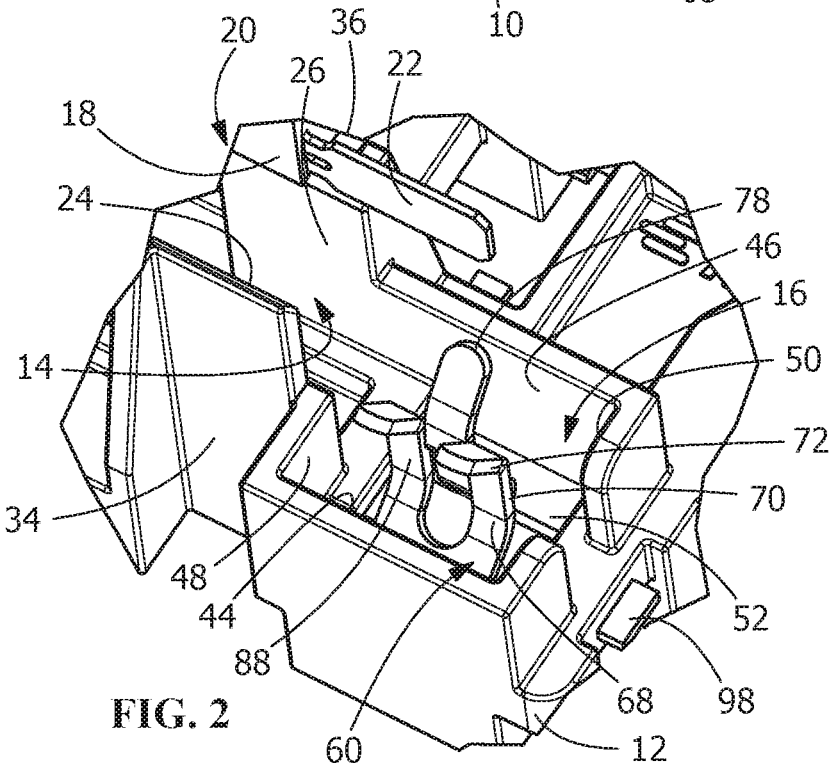
FIG. 2 is a top perspective view of a contact receiving recess with a current carrying clip contact positioned therein.

As shown in FIG. 2, current carrying clip contacts 60 are provided in the contact receiving recesses 16. Each of the current carrying clip contacts 60 has a base 62 with a first end 64 and an oppositely facing second end 66.

Figure 3:
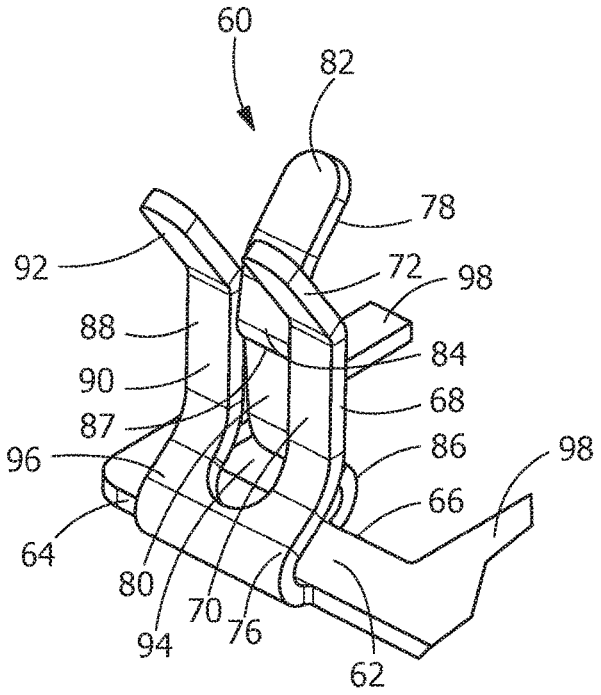
FIG. 3. is a perspective view of an illustrative embodiment of the current carrying clip contact.

As shown in FIG. 3, a first stationary beam 68 extends from the first end 64 of the base 62. The first stationary beam 68 has a first planar tab engagement section 70 and a first lead-in surface 72 which extends from the first planar tab engagement section 70. The first lead-in surface 72 is angled relative to the first planar tab engagement section 70. The first stationary beam 68 has a first arcuate mounting section 76 which extends from the first end 64 of the base 62 to the first planar tab engagement section 70.

A movable beam 78 extends from the second end 66 of the base 62. The movable beam 78 has a second planar tab engagement section 80, an arcuate retention section 84 extending from the second planar tab engagement section 80, and a second lead-in surface 82 extending from the arcuate retention section 84. The second lead-in surface 82 is angled relative to the second planar tab engagement section 80. The arcuate retention section 84 has a tab engagement shoulder 87. The arcuate retention section 84 of the movable beam 78 is movable across a plane 74 of the first planar tab engagement section 70 of the first stationary beam 68 as a tab 22 of the passive component 20 is inserted between the first stationary beam 68 and the movable beam 78. The movable beam 78 has a second arcuate mounting section 86 which extends from the second end 66 of the base 62 to the second planar tab engagement section 80.

A second stationary beam 88 extends from the first end 64 of the base 62. The second stationary beam 88 has a third planar tab engagement section 90 and a third lead-in surface 92 which extends from the third planar tab engagement section 90. The third lead-in surface 92 is angled relative to the third planar tab engagement section 90. The second stationary beam 88 has a third arcuate mounting section 96 which extends from the first end 64 of the base 62 to the third planar tab engagement section 90.

The first stationary beam 68 and the second stationary beam 88 are spaced apart. An opening or slot 94 is provided between the first stationary beam 68 and the second stationary beam 88. The slot 94 is dimensioned to receive the arcuate retention section 84 of the movable beam therein 78.

In various illustrative embodiments, the first lead-in surface 72 of the first stationary beam 68 and the third lead-in surface 92 of the second stationary beam 88 may be angled less relative to the plane 74 of the first planar tab engagement section 70 of the current carrying clip contact 60 than the second lead-in surface 82 of the movable beam 78.

One or more mating contact engagement sections 98 of each current carrying clip contact 60 extends from the base 62 to make an electrical connection to a mating contact (not shown). A portion of the mating contact engagement sections 98 is provided in an opening 43 of the housing 12 which extends below the bottom wall 52 of a respective contact receiving recess 16. In the illustrative embodiment shown, the housing 12 is overmolded over the mating contact engagement sections 99 and the bases 62 of the contacts 60 to secure the contacts 60 in the contact receiving recesses 16.

Figure 4:
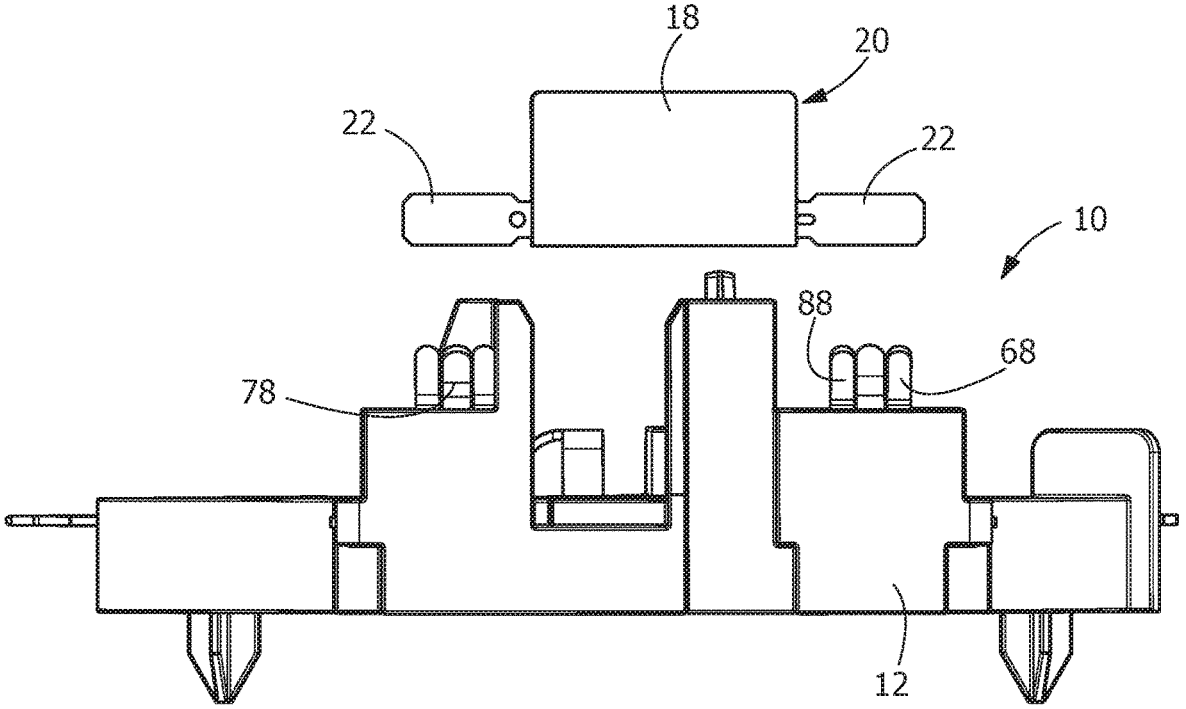
FIG. 4 is a front view of the electrical connector with a component positioned prior to engagement with the current carrying clip contact.
Figure 5:
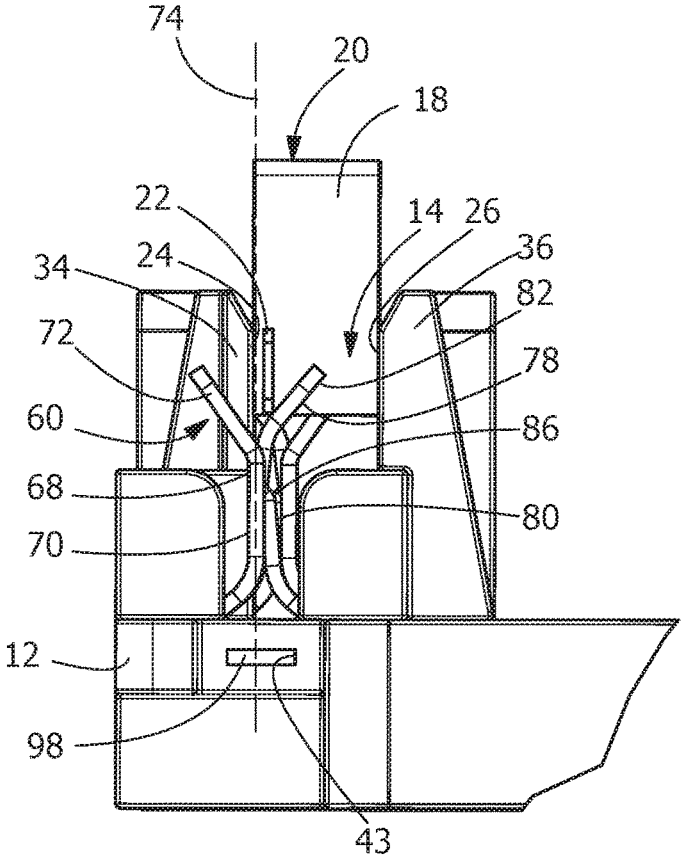
FIG. 5 is a side view of the electrical connector with a component positioned prior to engagement with the current carrying clip contact.

With the electrical connector 10 fully assembled and properly positioned, the component 20 is moved into an initial position relative to the component receiving recess 14 and the contact receiving recesses 16, as shown in FIGS. 4 and 5. In this position, the component housing 18 is positioned above the component receiving recess 14 and the component tabs 22 are positioned above the contact receiving recesses 16.

Figure 6:
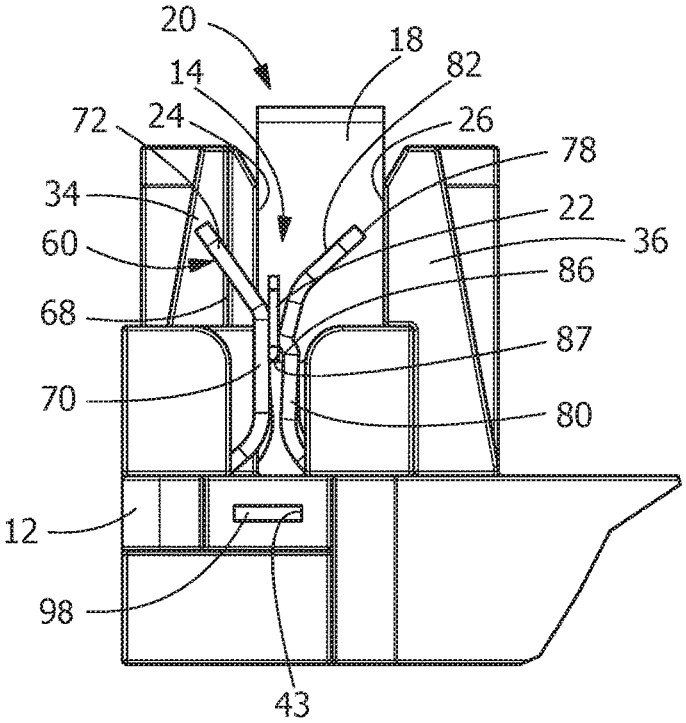
FIG. 6 is a side view of the electrical connector with the component partially inserted into the current carrying clip contact.

As the component 20 is inserted into the electrical connector 10, the component housing 18 engages the guide projections 34, 36 to guide the component housing 18 into the component receiving recess 14. As insertion occurs, the component tabs 22 engage the second lead-in surfaces 82 of the movable beams 78, as shown in FIG. 6.

As insertion continues, the component tabs 22 slide across the second lead-in surface 82 of the movable beam 78. As shown in FIG. 6, the tabs 22 are offset from the first stationary beams 68 and the second stationary beams 88 and are positioned in line with the movable beams 78. Consequently, the downward movement of the tabs 22 causes the movable beams 78 to be resiliently moved away from the first stationary beams 68 and the second stationary beams 88. As this occurs, the arcuate retention sections 84 of the movable beams 78 are moved out of the slots 94 and away from the first stationary beam 68 and the second stationary beam 88, allowing for the continued insertion of the component tabs 22 into the current carrying clip contacts 60.

As the tabs 22 are inserted, the movable beams 78 are moved rather than the first stationary beams 68 or the second stationary beams 88. The configuration of the arcuate retention sections 84 causes the movable beams 78 to be moved away from the first stationary beams 68 and the second stationary beams 88 when engaged by the tabs 22. This is due to the arcuate or sloped configuration of the arcuate retention sections 84. In addition, the first lead-in surfaces 72 of the first stationary beams 68 and the third lead-in surfaces 92 of the second stationary beams 88 are not positioned in line with the tabs 22 of a properly inserted component 20. However, if the tabs 22 are not properly aligned, the first lead-in surfaces 72 of the first stationary beams 68 and the third lead-in surfaces 92 of the second stationary beams 88 act as a guide to properly position the tabs 22. As this alignment occurs, the first stationary beams 68 and the second stationary beams 88 are not deformed, but retain their position and configuration. As each of the tabs 22 engage both the first the first stationary beam 68 and the second stationary beam 88 on one side, the force required to move the first stationary beam 68 and the second stationary beam 88 is greater than the force required to move the single movable beam 78.

Figure 7:
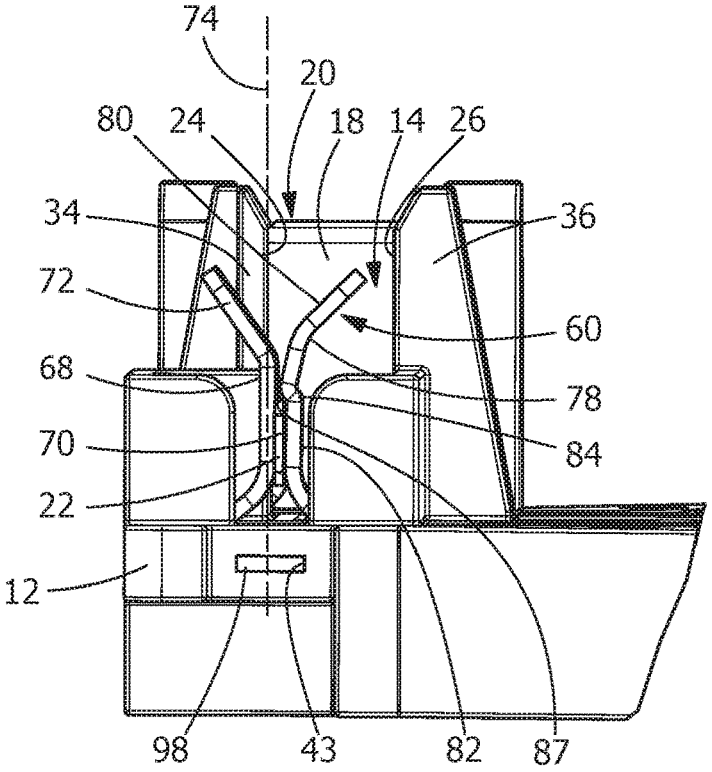
FIG. 7 is a side view of the electrical connector with the component fully inserted into the current carrying clip contact.
Figure 8:
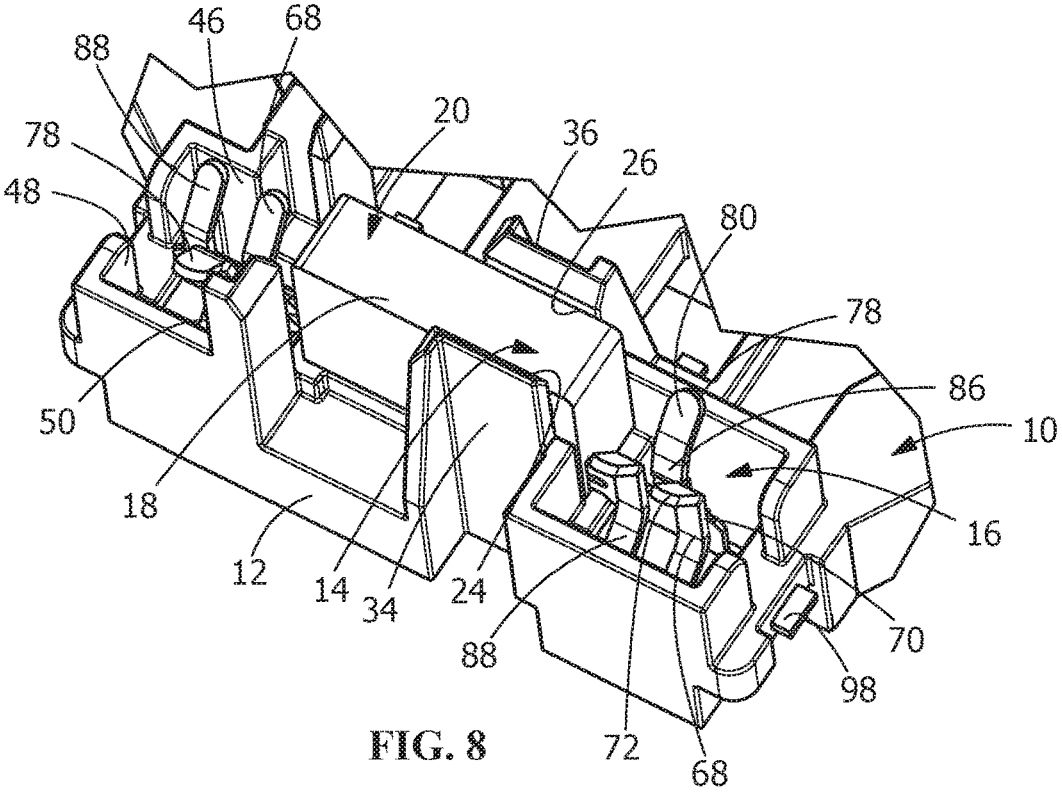
FIG. 8 is a top perspective view of the electrical connector with the component fully inserted.

As insertion continues, the component tabs 22 are moved past the arcuate retention sections 84, allowing the arcuate retention sections 84 and the movable beams 78 to return toward their unstressed positions in which the arcuate retention sections 84 are positioned in the slots 94. In this fully inserted position, the tabs 22 are positioned between and are in electrical engagement with the first planar tab engagement section 70 of the first stationary beam 68, the third planar tab engagement section 90 of the second stationary beam 88 and the second planar tab engagement section 80 of the movable beam 78, as shown in FIG. 7. In this position, the tab engagement shoulders 87 cooperate with top ends of the tabs 22 to retain the tabs 22 in the fully inserted position. With the tabs 22 fully inserted, the component housing 18 is also fully inserted into the component receiving recess 14, as shown in FIG. 8.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A current carrying clip contact comprising:

a base having a first end and an oppositely facing second end;

a first stationary beam having a first planar tab engagement section and a first lead-in surface which extends from the first planar tab engagement section, the first lead-in surface being angled relative to the first planar tab engagement section;

a movable beam having a second planar tab engagement section, an arcuate retention section extending from the second planar tab engagement section, and a second lead-in surface extending from the arcuate retention section, the second lead-in surface being angled relative to the second planar tab engagement section;

wherein the arcuate retention section of the movable beam being movable across a plane of the first planar tab engagement section of the first stationary beam as a mating tab is inserted between the first stationary beam and the movable beam.

2. The current carrying clip contact as recited in claim 1, wherein a second stationary beam is provided, the second stationary beam having a third planar tab engagement section and a third lead-in surface which extends from the third planar tab engagement section, the third lead-in surface is angled relative to the third planar tab engagement section.

3. The current carrying clip contact as recited in claim 2, wherein a slot is provided between the first stationary beam and the second stationary beam, the slot is dimensioned to receive the arcuate retention section of the movable beam therein.

4. The current carrying clip contact as recited in claim 3, wherein the first lead-in surface of the first stationary beam and the third lead-in surface of the second stationary beam are angled less relative to a longitudinal axis of the current carrying clip contact than the second lead-in surface of the movable beam.

5. The current carrying clip contact as recited in claim 2, wherein the first stationary beam has a first arcuate mounting section which extends from the first end of the base.

6. The current carrying clip contact as recited in claim 5, wherein the second stationary beam has a third arcuate mounting section which extends from the first end of the base.

7. The current carrying clip contact as recited in claim 1, wherein the arcuate retention section has a tab engagement shoulder.

8. The current carrying clip contact as recited in claim 7, wherein the movable beam has a second arcuate mounting section which extends from the second end of the base.

9. The electrical connector as recited in claim 8, wherein a mating contact engagement section extends from the base to make an electrical connection to a mating contact.

10. The electrical connector as recited in claim 9, wherein the guide projections of the component receiving recess are overmolded into the housing of the electrical connector.

11. The electrical connector as recited in claim 10, wherein second stationary beams are provided, the second stationary beams having third planar tab engagement sections and third lead-in surfaces which extend from the third planar tab engagement sections, the third lead-in surfaces are angled relative to the third planar tab engagement sections.

12. The electrical connector as recited in claim 11, wherein the arcuate retention sections have tab engagement shoulders.

13. The electrical connector as recited in claim 12, wherein the movable beams have arcuate second mounting sections which extend from the second ends of the bases.

14. The electrical connector as recited in claim 13, wherein the first lead-in surfaces of the first stationary beams and the third lead-in surfaces of the second stationary beams are angled less relative to longitudinal axis of the current carrying clip contacts than the second lead-in surfaces of the movable beams.

15. An electrical connector for receiving a passive component, the passive component having a component housing and component tabs, the electrical connector comprising:

a housing having a component receiving recess and contact receiving recesses positioned on either side of the component receiving recess, the component receiving recess having guide projections to properly position the component housing in the component receiving recess;

current carrying clip contacts in the contact receiving recesses, the current carrying clip contacts comprising:

bases having first ends and oppositely facing second ends;

first stationary beams having first planar tab engagement sections and first lead-in surfaces extending from the first planar tab engagement sections, the first lead-in surfaces being angled relative to the first planar tab engagement sections;

movable beams having second planar tab engagement sections, arcuate retention sections extending from the second planar tab engagement sections, and second lead-in surfaces extending from the arcuate retention sections, the second lead-in surfaces being angled relative to the second planar tab engagement sections;

wherein the arcuate retention sections of the movable beams being movable across planes of the first planar tab engagement sections of the first stationary beams as the component tabs are inserted between the first stationary beams and the movable beams.

16. The electrical connector as recited in claim 15, wherein the guide projections are positioned on either side of the component receiving recess.

17. The electrical connector as recited in claim 16, wherein slots are provided between the first stationary beams and the second stationary beams, the slots are dimensioned to receive the arcuate retention sections of the movable beams therein.

18. The electrical connector as recited in claim 17, wherein the first stationary beams have first arcuate mounting sections which extend from the first ends of the bases.

19. The electrical connector as recited in claim 18, wherein the second stationary beams have third arcuate mounting sections which extend from the first ends of the bases.

20. The electrical connector as recited in claim 19, wherein the housing is overmolded over the current carrying clip contacts.

* * * * *